US005611360A

United States Patent [19]

Tang

[11] Patent Number: 5,611,360

[45] Date of Patent: Mar. 18, 1997

[54] SMOKING ARTICLE

[75] Inventor: Jiunn-Yann Tang, Louisville, Ky.

[73] Assignee: Brown & Williamson Tobacco Corp., Louisville, Ky.

[21] Appl. No.: 284,251

[22] Filed: Aug. 2, 1994

Related U.S. Application Data

[63] Continuation of Ser. No. 69,126, May 28, 1993, abandoned.

[51] Int. Cl.[6] ..... A24F 1/22

[52] U.S. Cl. ..... 131/194; 131/359; 131/364

[58] Field of Search ..... 131/194, 364, 131/359

[56] References Cited

U.S. PATENT DOCUMENTS 3,258,015 2/1964 Ellis et al. .

4,474,191 10/1984 Steiner ..... 131/198 A 5,119,834 6/1992 Shannon et al. ..... 131/194

*Primary Examiner*—James J. Seidleck

*Assistant Examiner*—Duc Truong

*Attorney, Agent, or Firm*—Middleton & Reutlinger; Charles I. Sherman; Charles G. Lamb

[57] ABSTRACT

A smoking article including a porous inner core of an aerosol-generating composition circumscribed by a porous ceramic insulator tube which in turn is circumscribed by a porous charcoal fuel tube. Upon ignition, the smoking article, which is preferably in a cigarette rod form, produces an aerosol that resembles tobacco smoke.

28 Claims, 1 Drawing Sheet

SMOKING ARTICLE

This application is a continuation of Ser. No. 08/069,126 filed May 28, 1993 now abandoned.

BACKGROUND OF THE INVENTION

1. Field Of The Invention

This invention relates to smoking articles preferably in a cigarette form. In one aspect, it relates to a smoking article which produces an aerosol that resembles tobacco smoke but has substantially reduced amounts of smoke as produced by conventional cigarettes. In another aspect, the invention relates to a smoking article wherein tobacco is utilized as a flavor generating system. In even another aspect, the invention relates to a smoking article wherein tobacco flavors therein are volatilized but the tobacco is not combusted.

2. Description Of The Prior Art

Many smoking articles have been proposed in the last few years wherein tobacco or other carbon fuel sources are utilized to heat a core of tobacco or tobacco substitutes to a temperature less than the combustion temperature for the tobacco or tobacco substitutes, but which will volatilize the tobacco flavors contained within the core products.

These proposed smoking articles have been in many instances based on the use of heat to generate an aerosol or vapor containing tobacco flavors. Moreover, many different smoking articles have been proposed which actually burn a fuel source, which may be tobacco or other carbon sources, as a heating fuel wherein the heat generated from the combustible elements volatilize the tobacco flavors either from tobacco or a tobacco substitute material. The earliest such smoking articles were described in U.S. Pat. No. 3,258,015 to Ellis et al which teaches the use of a high heat tubular member containing a nicotine-releasing material surrounded by any heating means which will heat the nicotine-releasing material to a temperature between 200° and 400° C. The nicotine-releasing material may be tobacco, reconstituted tobacco, tobacco extract, or a synthetic mixture containing nicotine, such that nicotine is from 5% to 20% of the material by weight. This reference further teaches the use of fine cut tobacco for the heating means and mixing it with smoldering enhancers such as sodium chlorate, potassium chlorate, sodium nitrate, or potassium nitrate. Moreover, other materials such as carbon fuel may be used as the heating means. The Ellis et al patent further teaches the use of an aerosol-nucleating chamber which allows cooling so that the nicotine vapors condense on the aerosol particles. This chamber may be between the mouthpiece or filter and the heating means, in the middle of the tubular member, or some combination of these.

In U.S. Pat. No. 3,356,094 to Ellis et al, the metal tubular member of the '015 Ellis et al patent is replaced with a frangible or friable material. This reference teaches using an inorganic salt which loses water or carbon dioxide and becomes brittle when heated. Salts disclosed are magnesium sulfate heptahydrate, magnesium carbonate trihydrate, basic carbonates of magnesium, sodium or potassium bicarbonate and calcium sulfate. Plasticizers listed are colloidal silicate, magnesium oxide, ground chalk, and kaolin. Another reference, U.S. Pat. No. 4,474,194 to Steiner, teaches the use of ceramics or baked clays to separate the heating means from the tobacco simulating substance. Moreover, this reference teaches replacing tobacco as a heating means with a cellulose-base product mixed with activated charcoal and impregnated with appropriate aromatic compounds to provide a tobacco-like aroma.

U.S. Pat. No. 4,714,082 to Banerjee et al teaches placing the heating means and the aerosol-generating means in a tandem relationship rather than a coaxial relationship as set forth in the previously discussed references. In Banerjee et al, the heating means may contain combustible carbon in addition to reconstituted carbon and the aerosol generation means may contain alumina impregnated with an aerosol-forming material with a mass of tobacco located adjacent thereto.

SUMMARY OF THE INVENTION

The present invention advantageously provides a straight forward arrangement of a smoking article which is in cigarette form. The present invention further provides a smoking article with an aerosol-generating means in a conductive heat exchange relationship with a fuel element separated by an insulator. The present invention even further provides a smoking article where upon ignition a fuel element is utilized to generate sufficient heat to volatilize the aerosol-forming mixture of tobacco and tobacco substitutes to provide a high mainstream aerosol delivery that resembles smoke.

Further, the present invention provides a smoking article comprising a longitudinally extending porous charcoal fuel tube circumscribing a longitudinally extending porous ceramic tube which in turn circumscribes a longitudinally extending core of an aerosol-generating composition.

More particularly, the present invention provides a smoking article comprised of three elements in a concentrically arranged coaxial configuration wherein a porous charcoal fuel element circumscribes a porous ceramic insulating tube which in turn circumscribes a core of an aerosol-generating composition. A mouthpiece or filter is attached at one end of the smoking section of said smoking article. Upon ignition of the fuel element, sufficient heat is generated to volatilize the aerosol flavors in the aerosol flavor mixture in the core of the article, whereby volatilized gases are drawn towards the mouthend of the smoking section of the article, through the mouthpiece, and into the user's mouth, resulting in an intake sensation very similar to that of smoke from a conventional cigarette.

BRIEF DESCRIPTION OF THE DRAWING

Referring to the drawing.

1.

2.

DESCRIPTION OF THE PREFERRED EMBODIMENT

Figure 1:
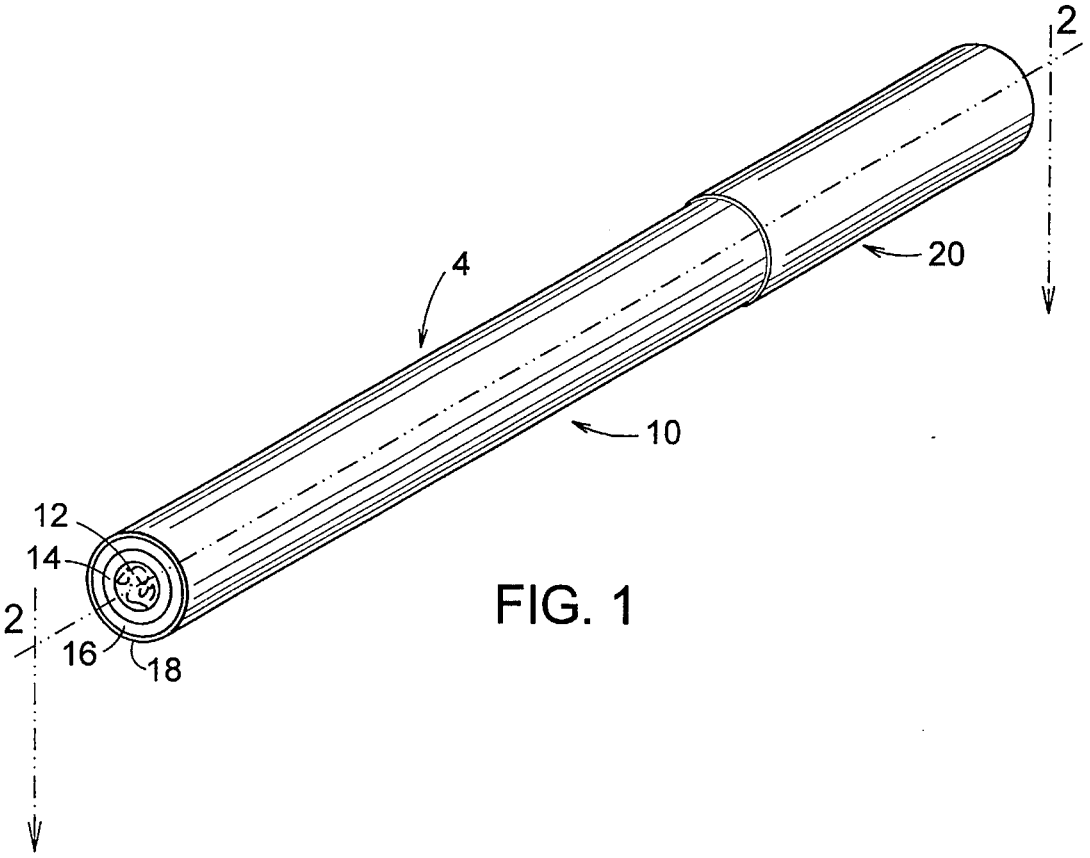
FIG. 1 is a perspective view of one preferred smoking article of the present invention.
Figure 2:
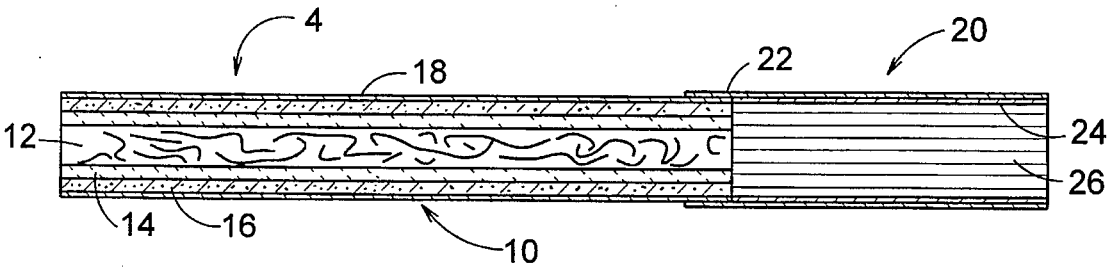
FIG. 2 is a sectional view of the smoking article of FIG. 1 taken along the lines 2—2 of FIG. 1; and, 3.

In FIGS. 1 and 2, a smoking article 10 is shown which includes a core of an aerosol-generating tobacco mixture 12 which is circumscribed by a porous ceramic insulating tube 14. The porous ceramic insulating tube 14 is circumscribed by a porous charcoal fuel tube 16, all of which is wrapped in conventional cigarette wrapping paper 18. The core of aerosol-generating tobacco mix 12, the ceramic insulating tube 14, and the charcoal fuel tube 16 all extend longitudinally in a coaxial relationship the entire length of the smoking section 4 of smoking article 10.

FIG. 2 shows article 10 with a filter 20 attached on the right-most distal portion of the smoking section 4 of smoking article 10. Filter 20 includes a cellulose acetate filter plug 26, which is circumscribed by a plug wrap 24. The filter 20 is connected to the smoking section 4 by means of tipping paper 22 which overlaps both the plug 26 and the wrap 24. In one preferred smoking article, the rod length is approximately 84 mm long with the smoking section 4 being 57 mm and the mouthpiece 30 being 27 mm in length. The diameter of the rod is 7.86 mm, with both the ceramic insulating tube 14 and the charcoal fuel tube 16 having walls 1 mm thick, with the inner core of the aerosol-generating mix being 3.86 mm thick.

Figure 3:
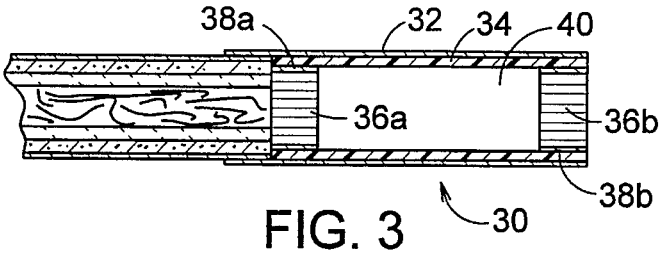
FIG. 3 is a sectional view of a modification of the mouthpiece end of the smoking article of FIGS. 1 and 2.

In FIG. 3, one preferred modification of the mouthend of the present invention is shown. In this embodiment, a mouthpiece 30 is attached to the right-most distal portion of the smoking section 4 instead of a filter 20, as was shown in FIG. 2. The mouthpiece 30 is comprised of a hollow plastic tube 34, with filter plugs 36*a* and 36*b*, circumscribed by plug wraps 38*a* and 38*b*, respectively. Plugs 36*a* and 36*b* are insertable in each end of the hollow plastic tube 34, thereby forming a condensing chamber 40 therebetween.

The porous fuel element 16 is generally composed of a charcoal fuel in a rod-like tubular form. Preferably, the fuel composition includes carbon, potassium citrate and potassium carbonate, all of which are combustible. However, in order to reduce the problems of sparking fire from ignition, a low bulk density silicate, such as V-30R Perlite, which is an aluminum silicate from Filter Media Company, or ammonium polyphospates may be added to the fuel composition as combustion modifiers to alleviate the problem of fire sparking. Furthermore, in a preferred fuel composition, aluminum trihydrate is also useful as an effective inhibitor to prevent the burning cone from sparking. The porosity of the fuel structure has been found to be critical to improving the ignitability and smoderability of the fuel element 16 by allowing penetration of air into the burning zone. It has also been found that increasing the content of low bulk density aluminum silicate or ammonium polyphospates in the fuel composition improves not only the fuel ignition ability and smolderability, but also improves the ash characteristics. The aforesaid inert fillers function as diluents to increase porosity and to lower the carbon content of the fuel which in turn lowers the combustion temperature of fuel element 16.

In the ceramic insulator tube 14 of the preferred embodiment, the preferred ceramic material is porous, light weight, and of very low bulk density. Preferably, materials used for the ceramic insulator tube 14 can readily be converted to colloidal forms by hydration, which materials may include: aluminum silicates, such as V-30R Perlite from Filter Media Company; highly hydratible aluminas, such as Versal GL from Kaiser Chemical; aluminum oxides, such as colloidal alumina from Degussa; and calcium silicate, such as Micro-Cel from John Mansville. In the present invention, the preferred ceramic insulator material is an alumina silicate as it has been found that alumina silicates not only have lighter weight, but facilitate the delivery of higher concentrations of selected aerosol flavors over other insulator materials. The insulator 14 may also be treated with flame retardants, such as diammonium phosphate and ammonium polyphosphate, or a chemical heat sink, such as alumina trihydrate, to lower the core temperature of the concentric elements.

The aerosol flavor-generating system 12 of the present invention includes an inner core mixture of both tobacco and tobacco snbstitutes that may be extruded into various forms, such as rolled sheets, strands and rods. The preferred composition includes chemical heat sinks and low bulk density inert fillers which assist in lowering the temperature at the core 12 during use. It has been found that incorporating inert filler, such as Perlite, adds to the porosity so as to provide a more effective aerosol-flavored delivery system. Overall, the porous structure of all three components in the coaxial configuration seems to play a key roll in the functioning of smoking devices having improved aerosol-generating properties.

The mouthpiece 30 may or may not be a hollow tube. The mouthpiece may be a regular cellular acetate filter plug. An aerosol-nucleating chamber 40 is not necessary, although it does allow for additional cooling of the smoke. The reason that aerosol nucleation, whereby the aerosol-generated vapors condense on the aerosol particles, is not necessary is that the porous structures of the fuel tube 16, aerosol mix 12 and insulator 14 of the present invention promote a sufficiently high aerosol-generated smoke delivery. Also, due to the porous nature of the frangible ceramic tube 14, the charcoal fuel 16 not only promotes good static, non-puff aided smoldering characteristics, but the burning cone glows upon drawing by the smoker and the ashes may be tapped off, just like a conventional cigarette on the market.

If the mouthpiece 20 is a regular filter, as shown in FIG. 2, the filter plug 26 may typically be made of cellulose acetate which retards the velocity of smoke flow, captures larger particles and reduces the overall temperature of the smoke. The filter plug 26 is typically circumscribed by a plug wrapper 24 and attached to one end of the smoking section 4 by means of tipping paper 22 which circumscribes both the entire filter 20 and 2–3 mm of the smoking section 4.

It is to be understood that the description and examples of the present invention given hereinafter are not by way of limitation and various modifications within a scope of the present invention will occur to those skilled in the art upon reading the disclosure set forth hereinafter.

What is claimed is:

1. A cigarette-type smoking article consisting of:

a smoking section defined by a longitudinally extending porous charcoal fuel tube circumscribing a longitudinally extending porous ceramic insulating tube, said porous ceramic insulating tube circumscribing a longitudinally extending core of a porous aerosol-generating composition; and, a mouthpiece attached at one end of the smoking section of said smoking article.

2. The smoking article of claim 1 wherein said porous charcoal fuel tube extends substantially the entire length of the smoking section of said smoking article.

3. The smoking article of claim 1 wherein said porous charcoal fuel tube includes spark inhibitors.

4. The porous charcoal fuel tube of claim 3 wherein one said spark inhibitor is aluminum trihydrate.

5. The smoking article of claim 1 wherein said porous charcoal fuel tube includes combustion modifiers.

6. The smoking article of claim 5 wherein said combustion modifiers include a compound selected from the group consisting of aluminum silicate and ammonium polyphosphate.

7. The smoking article of claim 1 wherein said porous ceramic insulating tube extends substantially the entire length of the smoking section of said smoking article.

8. The smoking article of claim 1 wherein the ceramic material comprising said porous ceramic insulating tube is readily converted to colloidal forms of hydration.

9. The smoking article of claim 8 wherein said colloidal forms of hydration include a compound selected from the group consisting of aluminum silicate, colloidal alumina and calcium silicate.

10. The smoking article of claim 1 wherein said porous ceramic insulating tube includes flame retardants.

11. The smoking article of claim 10 wherein said flame retardants include compounds selected from a group consisting of diammonium phosphate and ammonium polyphosphate.

12. The smoking article of claim 1 wherein said porous ceramic insulating tube includes a chemical heat sink.

13. The smoking article of claim 12 wherein said chemical heat sink is aluminum trihydrate.

14. The smoking article of claim 1 wherein said porous core of an aerosol-generating composition extends substantially the entire length of the smoking section of said smoking article.

15. The smoking article of claim 1 wherein said porous core of an aerosol-generating composition includes a chemical heat sink.

16. The smoking article of claim 15 wherein said chemical heat sink is aluminum trihydrate.

17. The smoking article of claim 1 wherein said core of an aerosol-generating composition includes inert fillers.

18. The smoking article of claim 17 wherein said inert fillers include aluminum silicate.

19. The smoking article of claim 1 wherein said core of an aerosol-generating composition includes compounds to lower the temperature of said aerosol-generating composition.

20. The smoking article of claim 19 wherein said compound to lower the temperature of said aerosol-generating composition include aluminum trihydrate.

21. The smoking article of claim 1 wherein said core of an aerosol-generating composition is in the form of an extrusion of said aerosol-generating composition.

22. The smoking article of claim 21 wherein said extrusion of said aerosol-generating composition is in the form of a rolled sheet.

23. The smoking article of claim 21 where said extrusion of said aerosol-generating composition is in the form of strands of material.

24. The smoking article of claim 21 wherein said extrusion of said aerosol-generating composition is in the form of a rod.

25. The smoking article of claim 1 wherein said core of aerosol-generating composition is comprised of tobacco and tobacco substitutes.

26. The smoking article of claim 1 wherein said mouthpiece is a regular filter.

27. The smoking article of claim 1 wherein said mouthpiece is a hollow plastic tube.

28. The smoking article of claim 27 wherein said hollow plastic tube includes an aerosol nucleating chamber.

* * * * *